United States Patent [19]

Giesselbach et al.

[11] Patent Number: 4,486,961

[45] Date of Patent: Dec. 11, 1984

[54] HAIR DRYER

[75] Inventors: Marinus Giesselbach; Wendela Giesselbach, both of Castricum, Netherlands

[73] Assignee: GAP Gesellschaft für Auswertungen und Patente AG, Glarus, Switzerland

[21] Appl. No.: 476,669

[22] Filed: Mar. 18, 1983

[30] Foreign Application Priority Data

Apr. 10, 1982 [DE] Fed. Rep. of Germany ..... 3213555

[51] Int. Cl.[3] ..... A45D 20/28

[52] U.S. Cl. ..... 34/80; 34/99; 34/100; 34/196; 34/197

[58] Field of Search ..... 34/80, 100, 99, 195, 34/196, 197

[56] References Cited

U.S. PATENT DOCUMENTS

| | | | |
|---|---|---|---|
| 2,412,407 | 12/1946 | Kilbury | 34/197 |
| 3,052,038 | 9/1962 | Harris | 34/80 |
| 4,022,560 | 5/1977 | Heinonen | 34/80 |

*Primary Examiner*—Larry I. Schwartz
*Attorney, Agent, or Firm*—A. A. Saffitz

[57] ABSTRACT

Apparatus and process for blow drying hair in which the air is dehumidified by passing it through a special housing fitted with a moisture-absorbing filter insert placed ahead of the air which impinges against the hair. A regeneratable drying agent such as aluminum oxide, silica gel, or the like constitutes the moisutre absorbing filter insert. In a preferred embodiment a fan driven by an electric motor sucks the drying air through a slit in a double-walled hood which fits over the hair so that the air sucked through the slit must pass through the filter insert into an inside wall portion of the hood which is perforated and lies next to the hair which is being dried. A holder for the hood is swivelably mounted so that it can be fixed to a wall. Moist air which reaches the outside hood is recirculated to the inside wall and again fed to the filter insert for repeated dehumidification. In this manner at least part, if not all, of the air is dehumidified. The warming from the motor need only be slight while the drying efficiency is enhanced. The saving in heating permits greater comfort to the person whose hair is being dried and the usual rise in temperature which accompanies ordinary blow drying is eliminated. The filter insert is regenerated in known mann by heating when it is saturated with moisture. Other embodiments are shown which are portable and hand held.

6 Claims, 8 Drawing Figures

HAIR DRYER

BACKGROUND OF THE INVENTION

1. Field of the Invention

The present invention relates to a process for blow drying hair and to an apparatus to carry out the process at lower temperatures.

2. Description of the Prior Art

In the prior art blow dryers and blow dryer methods employing blow dryer apparatus, a disadvantage to the user has been the considerable rise in temperature of the drying air which necessarily occurs under conditions of high humidity during drying. Efficient and rapid drying is desired to make such high temperatures necessary but the rise in temperature creates a marked feeling of unpleasantness to the person using the apparatus. This high temperature of the drying air to fulfill the need for rapid drying occurs under the conditions next to the wet hair which is itself at a very high relative humidity. In order to dry the hair, a larger amount of air is required as the relative humidity increases. The larger amounts of air needed and a higher temperature make for greater discomfort and a longer time which is required for drying, e.g. inefficiency and discomfort, which represent known attributes of prior art blow dryers.

OBJECTS OF THE INVENTION

An object of the invention is to provide a blow dryer embodying moisture absorption means for the drying air to permit drying at a generally lower temperature.

Another object of the invention is to provide a process for drying hair in which the air for drying is dehumidified prior to blowing through the hair in order to achieve a lower temperature for drying, temperatures as low as 37° C. and to dehumidify while recirculating the air thereby improving the drying efficiency.

SUMMARY OF THE INVENTION

The blow dryer of the invention in a preferred embodiment comprises a double-walled hood fitting over the head, a fan driven by an electric motor and a moisture absorbing filter insert means whereby air circulating within the double-walled hood is carried to an inside perforated wall and then must pass through a moisture-absorbing filter insert means to have its humidity removed thereby permitting a more efficient drying of the air which takes place at lower temperature than in convention blow dryers. Recirculation of air within the hood between the inner and outer walls of the hood is provided by the sucking action of the fan and in this embodiment heating of the air is provided by heating from the motor driving the fan. The drying air temperature can be reduced to a temperature of only 37° C., while dehumidification enhances the efficiency of drying.

A regenerating apparatus is provided for regenerating a plurality of spent, moisture laden filter inserts. A plurality of moisture laden inserts are placed in drawers and are adapted to be removed from the drawers in the housing of the regenerating apparatus.

In another embodiment of the invention a manually operated blow dryer comprises a housing, motor, fan and a long flexible hose terminating in a specially shaped drying nozzle which has interposed in the flexible hose portion immediately preceding the drying nozzle an exchangeable filter insert for drying the air passing through the drying nozzle. This embodiment further includes a heating means for the hose so that the air temperature can be predetermined at a comfortable level for the comfort of the person whose hair is being dried by the blower.

In a third embodiment of manual blow dryer the heating means of the flexible hose model described in the preceding paragraph is supplied by a converter for the motor which is mounted close to the motor and the fan and slows the rotation of the fan to a low value by the motor rotation whereby the air passing through the motor and fan is heated by the converter itself, thus saving energy. In this embodiment the air temperature in the hose may be raised to a value which is sufficiently high to regenerate a moisture laden filter insert while the insert is placed in its dehumidifying location. This model has the advantage of regenerating the filter insert as well as drying the hair without necessitating removal of the filter insert.

The novel process for drying hair applying the blow dryer of the present invention hastens drying and makes it more efficient. The process assures that air used for drying the hair is partially dehumidified prior to drying and further assures that recirculation is achieved within the hood to enhance drying without raising the temperature. The drying air is repeatedly dehumidified by recirculation.

BRIEF DESCRIPTION OF THE DRAWINGS

In the attached drawings, embodiments of the invention are shown by way of example.

DESCRIPTION OF THE PREFERRED EMBODIMENTS

Figure 1:
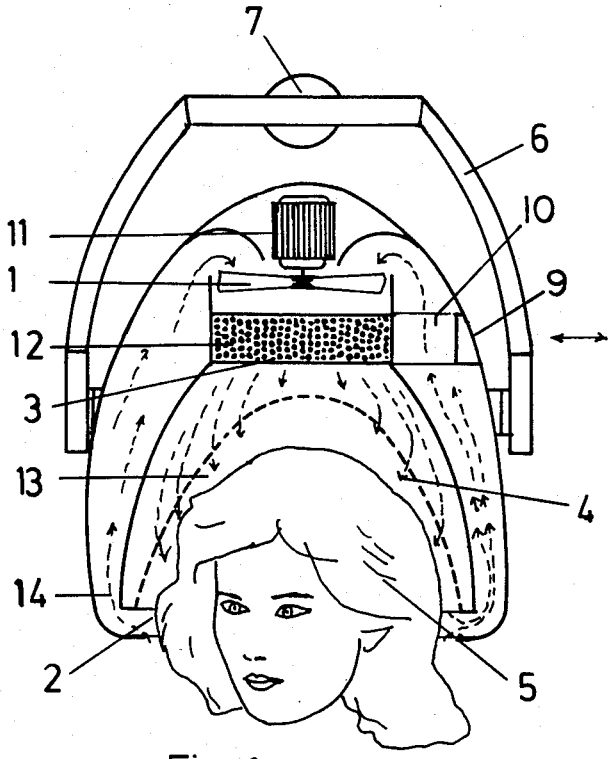
FIG. 1 shows a schematic, vertical section of a first embodiment of a hair dryer of the invention.
Figure 2:
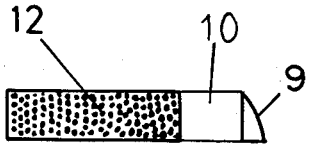
FIG. 2 shows a separate filter insert partly in vertical section.

As shown in FIG. 1 the blow dryer of the present invention comprises a fan 1 driven by an electric motor which is placed directly over a moisture-absorbing filter insert 12 and mounted inside a double-walled hood 14 providing recirculation of the air through the filter insert. The double-walled hood 14 comprising an outside hood 14 which surrounds an inside hood portion 13 having a perforated wall portion 4. The person whose hair is being dried is shown diagrammatically in FIG. 1 with the hair being swept or blown by air sucked in through the edge slit 2 and passing through the perforated wall portion on the inside wall as shown by the arrows in dotted line first through the outer or outside hood 14, then back through the filter insert 12 and against the hair. The air passage or flow in FIG. 1 is denoted by the arrows shown and follows a path first through the filter insert 12 and then through the perforations on the perforated inside wall 4 which constitutes the entire inside wall of the inside hood 13. Effectively, the path of the air which one understands from the direction of the arrows in FIG. 1 passing first from the slit then along the inner wall of the outside hood 14 then past the fan 1 through the insert 12 then through the perforations and then back again by recirculation demonstrates a circulation and recirculation of the air through the filter insert 12 whose function is to absorb moisture, based solely upon the special moisture absorbing characteristics of the filling which contains a known material, e.g. aluminum oxide or silica gel for this purpose.

As shown in FIG. 1 the entire arrangement of motor, fan, filter insert, double walled hood with outside 14 and inside 13 and perforated inside wall 4 constitutes a fixed unit which can be easily manipulated by its attaching mounting comprising holder 6. Note in FIG. 1 that stirrup-shaped holder 6 serves to mount, to support and to move the elements as a unit by means of the attachment 7. Attachment 7 is a swivel which permits holder 6 to be adjusted at 7 from a wall to which the holder 6 is attached, thereby adapting the unit for home or beauty shop.

Figure 3:
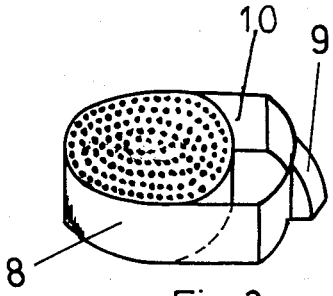
FIG. 3 shows an elevational view of the filter insert of FIG. 2.
Figure 4:
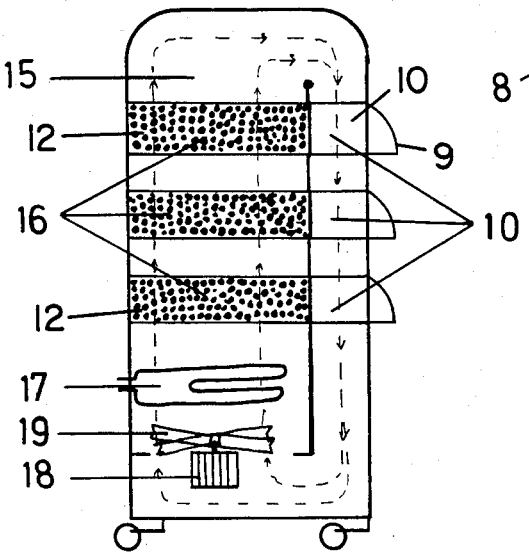
FIG. 4 is a schematic view in section showing apparatus for regenerating filter inserts.

As shown in FIGS. 1, 2, 3 and 4, the filter insert 12 consists of a moisture absorbing material, for example, aluminum oxide, $Al_2O_3$, or silica gel, $SiO_2$, which, after saturation is regenerated. In FIG. 4 it is received in a drawer-shaped container 8 which is provided with a handle 9, whereby an open passage 10 remains beside the filter insert 12 for the circulation of the hot air needed for regeneration.

In the manner described, the air is circulated and at least part of the air which is blown by the fan in circulation is repeatedly passed through to the filter insert 12 to thereby deplete its moisture content so that the filter insert eventually becomes saturated with moisture to require regeneration.

In each of the embodiments shown in FIGS. 1, 5*a*, 5*b*, 6*a* and 6*b*, the heating of the air which takes place is based upon the heat given up to the air from the motor but the alternate embodiments in FIGS. 5*a*, 5*b*, 6*a* and 6*b* contemplate added heating means.

Thus, it is a characteristic of all of the embodiments of the present invention that an essential heating means employed is that from the electric motor which serves to operate the fan which sucks the air through the hair. As a result, the electric requirement for the blow dryer of the invention is less than with conventional blow dryers which employs heating elements. The effectiveness of the filter insert 12, including its regenerating characteristics, is such that the drying operation will operate perfectly and more rapidly than with the conventional hair dryer. However, the filter unit 12 is relatively quickly saturated and the user must understand that it is necessary to regenerate it for the next drying operation.

The drying apparatus for regenerating the filter insert 12 is shown schematically in FIG. 4 and comprises a regeneration container 15 fitted with a plurality of drawers 16 disclosed one on top of the other, each of the drawers adapted for through air circulation as shown by the arrows and each adapted to receive a container 8 as shown in FIG. 3. The container 8 contains the saturated filter insert 12.

As shown in FIG. 4 a heating element 17 is provided which is disposed below the drawers 16 and above the fan 19 which is driven by electric motor 18 to force air in a circulation path shown by the arrows. The path of the warm air shown by the arrows in dotted line in FIG. 4 shows that the warm air from element 17 flows through the uppermost filter insert 12 and then the path of the air reverses and the air passes downwardly to the fan through the passages 10 in the drawers and which are shown at the right side of the filter inserts in the diagrammatic showing of FIG. 4. The downwardly moving air then returns to the bottom of the regeneration container 15 after which the air is again recirculated upwardly past the heating element 17 and again through the moisture laden filter inserts 12 to remove moisture therefrom in a second pass thereby repeating the regenerating operation.

It is contemplated that the drying of the filter insert within the regeneration container 15 may also be accomplished by vacuum means which may be aided by a fiberglass type filter pump.

It has been found that the regeneration container 15 and its operating elements quickly return the spent or moisture laden filter inserts to their dry and highly efficient moisture absorbing condition in a relatively short time period and in a simple manner as described above.

Figure 5A:
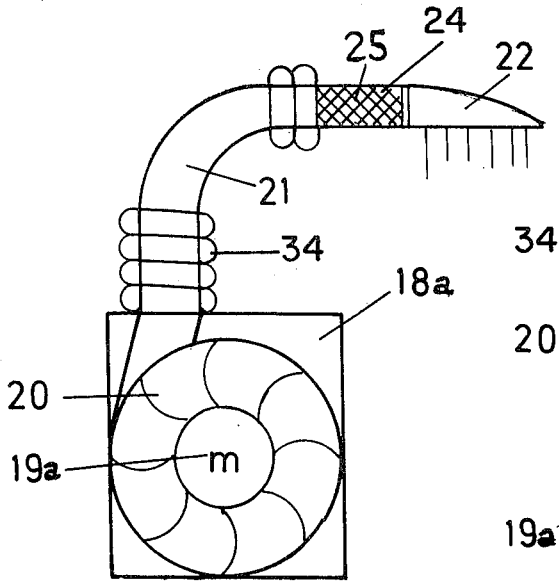
FIGS. 5*a* and 5*b* show a second embodiment of a hair dryer, partly in a side view and partly in section.
Figure 5B:
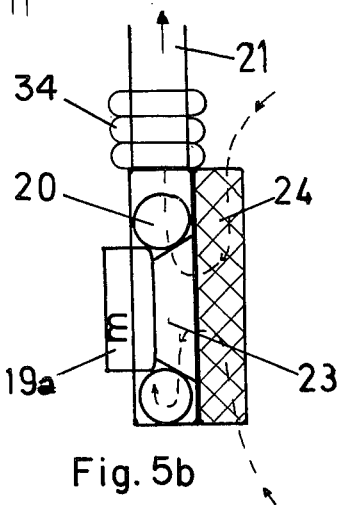

A second embodiment of the invention for drying and regeneration is shown in FIGS. 5*a* and 5*b*, this second embodiment being a portable blow dryer comprising a housing 18 having a motor 19, a fan which feeds air through an annular channel 20 and then through a flexible hose 21 to a warm air drying nozzle 22. A drying means forms part of the drying nozzle 22 and is illustrated in FIG. 5*a* by means of the hatched section immediately to the left of the side view. This drying means comprises a replaceable filter insert 24 which is seen in vertical section on the sectional side of FIG. 5*b*.

The portable hair dryer of FIGS. 5*a* and 5*b* includes a heating element 34 which is disposed about flexible hose 21 and is located above and on top of the housing 18 so that the air entering the hose outside of the housing can be immediately heated by this heating means. This heating means is a known construction and is shown in schematic form only. It is useful particularly for regeneration of the moisture-absorbing filter insert 24, the heat imparted to the air stream passing through the hose being capable of driving off moisture from the insert 24.

The dotted line and arrows indicate the pathways and passage of the air heated from the motor and blown by the fan through the annular channel 20, the air being passed through the filter insert 24 by suction. The placement of the replaceable filter insert 24 at connection 23 (see sectional view to the right of FIGS. 5*a* and 5*b*) assures that effective dehumidification occurs in this portable model. It is contemplated that a heating body 24 may be employed to heat the air for the purposes of regeneration. Thus, in FIGS. 5*a* and 5*b* and in contrast to the embodiment shown in FIG. 1 an additional heating means may be employed for regenerating the filter insert and the user can alternate between hair drying and regeneration modes.

Figure 6A:
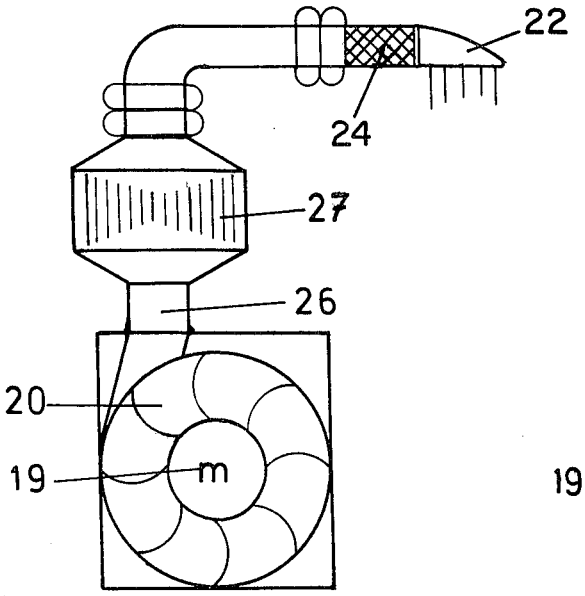
FIGS. 6*a* and 6*b* show a third embodiment of hair dryer for manual operation, partly in side view and partly in section.
Figure 6B:
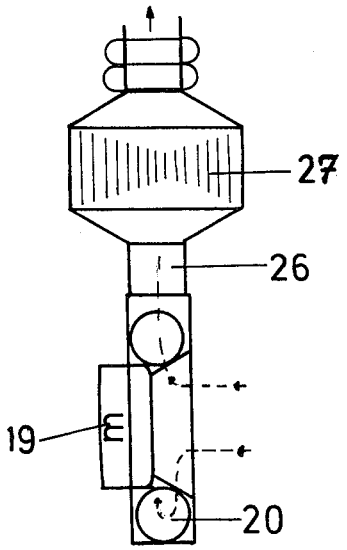

In FIGS. 6*a* and 6*b* a third embodiment of the invention is shown for portable operation and regeneration employing the same type of replaceable filter inserts. However, the motor of the fan is a special motor which operates at a very low rpm and also serves to warm the air. In this embodiment the low rpm motor sufficiently heats the air to regenerate the filter 24 after it is laden with moisture. In short, FIG. 6*a* is an embodiment of blow dryer with regenerator in which the converter 25 for motor speed is used as an auxiliary heat source for aiding regeneration and drying.

To accomplish the modification of the motor from a low cost motor operating at a single speed in a forward and a reverse mode, these being conventional motor features, converter 25 functions to control the speed of the motor in FIGS. 6*a* and 6*b* and thus constitutes a heating means where the heating element rather than being externally heated and auxiliary to the motor as heat source represents a part of the motor means for providing a low motor speed, whether forward or reverse. Thus, functionally, there is a similarity in purpose between the auxiliary head 34 in FIGS. 5*a* and 5*b* and the motor regulator or converter 25 in FIGS. 6*a* and 6*b*.

In all other respects, FIGS. 6*a* and 6*b* has the same motor 19, the same annular channel 20, the same flexible hose 21, the same general configuration of filter insert 24 but a totally different heat converter 25 is included instead of the heating means 34 of FIGS. 5*a* and 5*b*. The embodiment of FIGS. 6*a* and 6*b* thus constitutes a self regenerating embodiment comparable to FIGS. 5*a* and 5*b* in which the filter unit has not only the filter insert 24 for dehumidification at the nozzle 22 but an added heat converter 25 which is placed above the housing. The advantage of the FIGS. 6*a* and 6*b* embodiment is that the velocity of the air for blow drying is kept at a very low value, the motor itself can serve as a warming source for regeneration and a constant level of regeneration may be achieved. Thus FIG. 6 illustrates a third embodiment of manual blow dryer in which there is provided a separate location for regeneration of the filter insert unit 24 closer to the heat-generating blower and motor so that it can be placed within the housing 25 after the filter insert has picked up excess moisture to the degree that dehumidification is now required. By inserting the filter unit insert 24 into the housing at a location closer to the motor 19 in housing 25, the connector 26 conducts the air at a higher temperature which is closer to the motor than the normal position in the interior of the housing 25 in which the filter unit insert is placed for drying. The change in location for regeneration insures that the filter is brought to the motor output temperature more quickly because of the temperature gradient from the motor through the connector 26 to the housing 25 and the longer path of flexible hose 21 to the outlet. It is thus more efficient to relocate the filter insert 24 in the position within the housing closer to the motor for regeneration of the spent filter so that the motor operated at a warming source for regeneration at a low volume of air flow for blow-drying improves the efficiency of regeneration.

Comparing FIGS. 5*a* and 5*b* and FIGS. 6*a* and 6*b* portable hair drying embodiments, the FIGS. 6*a* and 6*b* embodiment uses the heat from motor regulation of motor 19 by the converter operation of converter 25 and is more economical to operate than is the heating element 34 used in a similar location of the hose. The advantage of FIGS. 5*a* and 5*b* is that more rapid regeneration can be achieved because the auxiliary heating element 34 can be obtained in any wattage rating while the amount of energy available for heating the air from converter 25 is that which is required to slow down the speed of the motor. Thus, the design considerations which are familiar to those skilled in the art will govern the selection of the appropriate known elements to achieve the purposes set out in the description hereinabove.

We claim:

1. A bonnet-shaped portable hair dryer adapted for first preheating and then drying of circulating warm air using a regeneratable drying filter unit heated by the blower motor said regeneratable drying unit adapted to be regenerated and reused consisting essentially of:

a double walled hood having an inner hood and an outer hood;

said inner hood being formed with an inwardly projecting inner wall flange to adapt a close fitting of the inner wall of said double walled hood close to and surrounding the hair of the person;

the lower edge of said outer hood being also disposed inwardly but at a distance to form a continuous edge slit with less than the inner wall flange of said inner walled hood thereby providing a continuous air inlet slit assuring the passage of all incoming air exclusively through the outer wall and also permitting the recirculation of air after it leaves the hair for passage back to the slit, upwardly through the outer walled hood and to the motor and fan for reheating and recirculation through the unitary filter insert;

said inner hood of said double-walled hood comprising an inner perforated wall which lies closest to the head of the person with the hood in place and said outer hood communicating with said inner hood so that all of the room temperature air enters the outer wall through the continuous edge slit at the lower edge and exits through the perforations of the inner perforated wall against the hair after being heated by the motor at the top of the hood;

a holder for mounting said double walled hood;

an electric motor mounted in said outer hood at the top of said double walled hood;

a fan mounted immediately below said motor;

a replaceable dehumidification unitary filter insert which is mounted immediately below said fan whereby all of the air which enters at room temperature into the double-walled hood at the lower edge passes upwardly from the outer wall of the double-walled hood to the motor for heating and then to the inner wall of the double-walled hood by means of such fan so as to pass through said filter insert unit and thereafter through the inner wall of said hood to directly impinge against the hair being dried;

said motor constituting the sole heating means placed at the top and over the filter unit and fan within the outer wall of the double-walled hood whereby all of the room temperature air passes along the entire height of the inside outer wall of the double-walled hood prior to being heated by said motor and prior to impinging on the hair; and said inner perforated wall of said double walled hood being perforated at the surface closest to the hair of the person whereby the air circulating upwardly through the outer wall of the double-walled hood is heated to a temperature of about 37° C. and brought through the unitary filter insert to dry it.

2. A hair dryer as claimed in claim 1 wherein the top of said inner wall member of the double-walled hood is formed to provide a housing for the dehumidifying unitary filter insert.

3. A hair dryer according to claim 1, including a regenerating means for the filter insert to restore its water-absorbing capacity comprising:

a regenerating container;

a plurality of vertical drawers disponsed one on top of the other;

each of said drawers having passageways adapting the through-flow of air when the drawers are placed in the container;

each of said drawers holding a spent filter insert through which air passing through the drawers also passes;

a heating element below the lowest of said drawers in said container; and a fan and a motor below said heating element which circulates the air past said heating element and recirculates the air to the passages in said drawers whereby regeneration of said filter inserts takes place with the expulsion of moisture.

4. A portable hair dryer as claimed in claim 1 wherein the motor and fan are contained in a housing;

the fan and motor are located at the center of an annular passageway through which air from the fan passes to a flexible hose at the outlet of said passageway;

a flexible hose terminating in a nozzle and a fitting before the nozzle at the end of the hose which consists of a replaceable filter insert having moisture-absorbing material contained therein;

the motor providing heat which is adequate to warm the temperature of the air passing through the hose, filter insert and nozzle.

5. A blow dryer as claimed in claim 4 including auxiliary heating means surrounding said hose to heat the air within the hose;

said auxiliary heating means adapted to regenerate the moisture-absorbing material in the filter insert.

6. A blow dryer as claimed in claim 5 wherein said auxiliary heating means constitutes a converter which slows down the speed of said motor and which imparts heat to the air in the hose which is used to pass through the filter in regenerating the filter.

* * * * *